United States Patent [19]

Kapuscinski et al.

[11] Patent Number: 4,820,776

[45] Date of Patent: Apr. 11, 1989

[54] HYDROCARBON COMPOSITIONS CONTAINING POLYOLEFIN GRAFT POLYMERS HAVING AMINE AND PHENOTHIAZINE GRAFTED MOIETIES

[75] Inventors: Maria M. Kapuscinski, Carmel; Larry D. Grina, Wappingers Falls; Ronald E. Jones, Glenham; Rodney L. Sung, Fishkill, all of N.Y.

[73] Assignee: Texaco Inc., White Plains, N.Y.

[21] Appl. No.: 726,567

[22] Filed: Apr. 24, 1985

[51] Int. Cl.[4] ..... C08F 255/06; C08F 255/04

[52] U.S. Cl. ..... 525/279; 525/281; 525/284; 525/293; 525/349; 525/331.7

[58] Field of Search ..... 525/279, 256, 331.7, 525/284, 349, 281, 293

[56] References Cited

U.S. PATENT DOCUMENTS

| | | | |
|---|---|---|---|
| 4,085,055 | 4/1978 | Durand et al. | 525/279 |
| 4,096,319 | 6/1978 | Willette et al. | 526/257 |
| 4,282,132 | 8/1981 | Benda et al. | 525/279 |
| 4,340,689 | 7/1982 | Joffrion | 525/279 |

FOREIGN PATENT DOCUMENTS

| | | | |
|---|---|---|---|
| 950315 | 2/1964 | United Kingdom | 525/279 |
| 1068283 | 5/1967 | United Kingdom | 525/279 |

*Primary Examiner*—Wilbert J. Briggs, Sr.
*Attorney, Agent, or Firm*—Robert A. Kulason; James J. O'Loughlin; Carl G. Seutter

[57] ABSTRACT

Fuel oils and lubricants of improved properties contain ethylene-propylene copolymers bearing units derived fron N-vinyl pyrrolidone and phenothiazine.

3 Claims, No Drawings

HYDROCARBON COMPOSITIONS CONTAINING POLYOLEFIN GRAFT POLYMERS HAVING AMINE AND PHENOTHIAZINE GRAFTED MOIETIES

FIELD OF THE INVENTION

This invention relates to hydrocarbons including hydrocarbon fuel oils and lubricating oil. More particularly, it relates to hydrocarbons which contain graft polymers which permit attainment of improved properties.

BACKGROUND OF THE INVENTION

As is well known to those skilled in the art, hydrocarbon fuels and lubricating oils must be formulated, as by addition of various additives, to improve their properties.

In the case of hydrocarbon fuels, typified by fuels boiling in the gasoline boiling range, kerosene, middle distillate fuels, home heating oils etc., it is found that after extended periods of storage, they are characterized by undesirable characteristics typified by formation of solid deposits within the system.

In the case of lubricating oils, typified by those employed in railway, automotive, aircraft, marine etc. service, it is found that they become degraded during use due inter alia to formation of sludge which may be generated by deterioration of the oil or by introduction of undesirable components from other sources including the fuel or the combustion air. In order to maintain and improve the properties of the lubricating oil, various additives have heretofore been provided; and these have been intended to improve the viscosity index, dispersancy, oxidative stability, etc. It is an object of this invention to provide an additive system which permits attainment of improved hydrocarbons. Other objects will be apparent to those skilled in the art.

STATEMENT OF THE INVENTION

In accordance with certain of its aspects, this invention is directed to a graft polymer comprising an oil-soluble, substantially linear, carbon-carbon backbone polymer having bonded thereto (i) first graft units derived from a first monomer amine containing a polymerizable, ethylenically unsaturated double bond and (ii) second units derived from a second monomer containing at least one of nitrogen, sulfur, or oxygen in a heterocyclic ring compound.

DESCRIPTION OF THE INVENTION

The charge polymer which may be employed in practice of the process of this invention may include an oil-soluble, substantially linear, carbon-carbon backbone polymer. Typical carbon-carbon backbone polymers prepared from monomers bearing an ethylenically unsaturated polymerizable double bond which may be employed include homopolymers or copolymers prepared from monomer

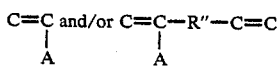

wherein A may be: hydrogen; hydrocarbon such as alkyl, aryl, etc.; phenyl; acetate or less preferred acyloxy (typified by —COOR); halide; etc. R″ may be divalent hydrocarbon typified by alkylene, alkarylene, aralkylene, cycloalkylene, arylene, etc.

Illustrative of such monomers may be acrylates, methacrylates, vinyl halides (such as vinyl chloride), styrene, olefins such as propylene, butylene, etc., vinyl acetate; dienes such as butadiene, isoprene, hexadiene, ethylidene norbornene, etc. Homopolymers of olefins, (such as polypropylene, polybutylene, etc.), dienes, (such as hydrogenated polyisoprene), or copolymers of ethylene with e.g., butylene and higher olefins, styrene with isoprene and/or butadiene may be employed. The preferred carbon-carbon backbone polymers include those selected from the group consisting of ethylene-propylene copolymers (EPM or EPR) and ethylene-propylene-diene third monomer terpolymers (EPDM or EPT).

When the charge polymer is an ethylene-propylene copolymer (EPM, also called EPR polymers), it may be formed by copolymerization of ethylene and propylene under known conditions preferably Ziegler-Natta reaction conditions. The preferred EPM copolymers contain units derived from ethylene in amount of 40–70 mole %, preferably 50–60 mole %, say 55 mole %, the remainder being derived from propylene.

The molecular weight $\overline{M}_n$ of the EPM copolymers which may be employed may be 10,000–1,000,000, preferably 20,000–200,000, say 140,000. The molecular weight distribution may be characterized by $\overline{M}_w/\overline{M}_n$ of less than about 15, preferably 1.2–10, say 1.6.

Illustrative EPM copolymers which may be employed in practice of the process of this invention may be those set forth in the following table, the first listed being preferred:

A. The Epsyn brand of EPM marketed by Copolymer Rubber and Chemical Corporation containing 60 mole % of units derived from ethylene and 40 mole % of units derived from propylene, having a molecular weight $\overline{M}_n$ of 140,000 and a $\overline{M}_w/\overline{M}_n$ of 1.6.

B. The Epcar 505 brand of EPM marketed by B. F. Goodrich Co., containing 50 mole % of units derived from ethylene and 50 mole % of units derived from propylene and having a $\overline{M}_n$ of 25,000 and a polydispersity index of 2.5.

C. The Esprene brand of EPR marketed by Sumitomo Chemical Co., containing 55 mole % of units derived from ethylene and 45 mole % of units derived from propylene and having a $\overline{M}_n$ of 25,000 and polydispersity index of 2.5;

When the charge polymer is a terpolymer of ethylene-propylene-diene third monomer (EPT or EPDM), it may be formed by copolymerization of ethylene, propylene and diene third monomer. The third monomer is commonly a non-conjugated diene typified by dicyclopentadiene; 1,4-hexadiene; or ethylidene norbornene. Polymerization is effected under known conditions generally comparable to those employed in preparing the EPM products. The preferred terpolymers contain units derived from ethylene in amount of 40–70 mole %, preferably 50–65 mole %, say 60 mole % and units derived from the propylene in amount of 20–60 mole %, preferably 30–50 mole %, say 38 mole % and units derived from third diene monomer in amount of 0.5–15 mole %, preferably 1–10 mole %, say 2 mole %. The molecular weight $\overline{M}_n$ of the terpolymers may typically be 10,000–1,000,000, preferably 20,000–200,000, say 120,000. Molecular weight distribution of the useful polymers is preferably narrow viz a $\overline{M}_n/\overline{M}_n$ of typically less than 15, preferably 1.5–10, say 2.2.

Illustrative EPT terpolymers which may be employed in practice of the process of this invention may be those set forth in the following table, the first listed being preferred:

TABLE

A. The Epsyn 4006 brand of EPT marketed by Copolymer Rubber and Chemical Corp., containing, 58 mole % of units derived from ethylene, 40 mole % of units derived from propylene, and 2 mole % of units derived from ethylidene norbornene and having a $\overline{M}_n$ of 120,000 and a polydispersity index $\overline{M}_w/\overline{M}_n$ of 2.2.

B. The Ortholeum 5655 brand of EPT marketed by DuPont containing 62 mole % of units derived from ethylene, 36 mole % of units derived from propylene, and 2 mole % of units derived from 1,4-hexadiene and having a $\overline{M}_n$ of 75,000 and a polydispersity index $\overline{M}_w/\overline{M}_n$ of 2.

C. The Ortholeum 2052 brand of EPT marketed by DuPont containing 62 mole % of units derived from ethylene, 36 mole % of units derived from propylene, and 2 mole % of units derived from 1,4-hexadiene and having a $\overline{M}_n$ of 35,000 and a polydispersity $\overline{M}_w/\overline{M}_n$ of 2.

D. The Royalene brand of EPT marketed by Uniroyal containing 60 mole % of units derived from ethylene, 37 mole % of units derived from propylene, and 3 mole % of units derived from dicyclopentadiene and having a $\overline{M}_n$ of 100,000 and a polydispersity index $\overline{M}_w/\overline{M}_n$ of 2.5.

E. The Epsyn 40A brand of EPT marketed by Copolymer Rubber and Chemical Corp., containing 60 mole % of units derived from ethylene, 37 mole % of units derived from propylene, and 3 mole % of units derived from ethylidene norbornene and having a $\overline{M}_n$ of 140,000 and a polydispersity index $\overline{M}_w/\overline{M}_n$ of 2.

The EPM and EPT polymers may contain minor portions (typically less than about 30%) of other units derived from other copolymerizable monomers.

It is a feature of the process of this invention that there may be grafted onto these oil-soluble, substantially linear carbon-carbon, backbone polymers, first graft units derived from a first graft amine monomer.

The functional amine monomer which may be grafted onto the EPM or EPT as the first graft monomer in practice of the process of this invention may be characterized by the formula RNR'R'' wherein R is a hydrocarbon moiety possessing a polymerizable ethylenically unsaturated double bond. R may be an alkenyl or cycloalkenyl group (including such groups bearing inert substituents) typified by vinyl, allyl, $C{=}C{-}C_6H_4{-}$, etc. R', R'' may be hydrogen or a hydrocarbon including alkyl, alkaryl, aralkyl, cycloalkyl, and aryl. The moiety-NR'R'', may include a heterocyclic ring (formed by joining R' and R'')as in the preferred N-vinyl pyrrolidone; 1-vinyl imidazol; or 4-vinyl pyridine. R' and R'' may be a hydrogen or a hydrocarbon moiety containing nitrogen, sulfur, or oxygen. Illustrative amines which may be employed include those listed in the following table, the first listed, N-vinyl pyrrolidone, being preferred:

TABLE

N-vinylpyrrolidone
1-vinylimidazole
4-vinylpyridine
allyl amine

The first graft monomer may be a more complex amine reaction product formed by the reaction of an amine, typified by morpholine or N-methyl piperazine, and an epoxy compound typified by allyl glycidyl ether. It may be a monomer formed for example from the reaction of croton aldehyde and N-(3-aminopropyl) morpholine.

In practice of the process of this invention, 100 parts of charge EPM or EPT may be added to 100–1000 parts, say 300 parts of solvent. Typical solvent may be a hydrocarbon solvent such as hexane, heptane, tetrahydrofuran, or mineral oil. Preferred solvent may be a commercial hexane containing principally hexane isomers. Reaction mixture may then be heated to reaction conditions of 60° C.–180° C., preferably 150° C.–170° C., say 155° C. at 15–300 psig, preferably 180–220 psig, say 200 psig.

In the preferred two step process, there are admitted to the reaction mixture first graft monomer, typically N-vinylpyrrolidone in amount of 1–40 parts, say 5 parts, and a solution in hydrocarbon of free radical initiator. Typical free radical initiators may include dicumyl peroxide, di-t-butyl peroxide, benzoyl peroxide, di-isopropyl peroxide, azobisisobutyronitrile, etc. The solvent is preferably the same as that in which the EPM or EPT is dissolved. The initiator may be added in amount of 0.2–10 parts, say 2 parts in 0.8–40 parts, say 16 parts of solvent.

The reaction is carried out at a temperature at least as high as the decomposition temperature of the initiator, typically 60° C. or higher.

Reaction is typically carried out at 60° C.–180° C., say 155° C. and 180–220 psig, say 200 psig during which time graft polymerization of the amine onto the base EPM or EPT polymer occurs. The final product graft polymer may be typically characterized by the presence of the following typical units:

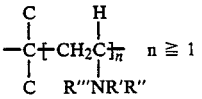

Typically there may be 0.1–80 say 6 amine per 1000 carbon atoms in the polymer backbone. R''' is saturated moiety derived from R.

It is a feature of the process of this invention that there may be bonded onto these oil-soluble, substantially linear, carbon-carbon, backbone polymers bearing units derived from a first graft monomer, units derived from a second functional monomer containing at least one of sulfur, nitrogen, or oxygen in a heterocyclic ring. Although it may be possible to effect bonding and graft polymerization simultaneously, it is preferred to effect graft polymerization first and thereafter bonding.

The second functional monomer which may be employed may be monocyclic or polycyclic; and the nitrogen, sulfur, and oxygen may be contained in the same or a different ring. In the preferred embodiment, the second functional monomer may be polycyclic and the nitrogen and sulfur may be in the same heterocyclic ring. This monomer may contain both heterocyclic and aromatic rings as is the case with the preferred phenothiazine.

The functional monomer may be a heterocyclic-/aromatic or heterocyclic compound containing sulfur, nitrogen or oxygen, or combination thereof. The compound which may be used as the functional monomer include:

1. Phenothiazine and ring or/and N-substituted phenothiazine. Substituents may include hydrocarbon radicals selected from the group consisting of alkyl, alkenyl, cycloalkyl, aryl, alkaryl, or heterocyclic, including such radicals when containing oxygen, nitrogen, sulfur, halide or their combinations. typically, the ring-substituted phenothiazine may include alkyl or alkenyl phenothiazines, alkoxy phenothiazine, hydroxy alkyl phenothiazines, amino phenothiazines, nitrophenothiazines, 3-formyl-10-alkyl-phenothiazine, 2-amino-4-(2-phenothiazinyl) thiazole, alpha-(2-phenothiazinyl) thioacetomorpholide, etc. Typical N-substituted phenothiazine may include N-vinyl phenothiazine, N-acrylamidomethyl phenothiazine, beta-(N-phenothiazinyl)-ethyl vinyl ether, beta-(N-phenothiazinyl)-ethyl methacrylates, reaction products of allyl glycidyl ether or glycidyl methacrylate with phenothiazine.
2. Immidazoles or benzimidazoles, such as 2-mercaptobenzimidazole, 2-mercapto toluimidazole or 2-mercapto-1-methyl imidazole.
3. Thiazoles or benzothizoles, such as 4-methyl-5-vinylthiazole, 2-amino-4-methyl-thiazole, 2-mercapto-4-phenylthiazole, 2-mercaptobenzo thiazole.
4. Triazoles and benzotriazols, such as 3-mercapto-1H-1,2,4, triazole, 3-amino-5-methylthio-1H-1,2,4-triazole.
5. Thiadiazoles, benzothiadiazoles, thiazolines and benzothiazolines, thiazolidine, including 2-mercaptothiazoline, 1,2,5-thiadiazoline.
6. Pyrimidine, including 2-amino-4-methylpyrimidine, 2-mercaptopyrimidine.
7. Pyridines, including 2-mercapto pyridine, 4-mercaptopyridine, 2-mercaptopyridine-N-oxide
8. Piperidines and pyrrolidinones.
9. Oxazoles and benzoxazoles, such as 2-mercaptobenzoxazole.
10. Mercaptoanilines, mercaptophenols, thiomorpholine, 6-mercaptopurine, thiophene methyl amine.

Preferred of the second functional monomers is phenothiazine which is a three-ring aromatic/heterocyclic compound containing nitrogen and sulfur in the same ring.

In practice of the process of this invention 100 parts of charge EPM or EPT (bearing units grafted thereon from the first graft monomers) may be added to 100–1000 parts, say 300 parts of diluent-solvent. Typical diluent-solvent may be a hydrocarbon solvent such as n-hexane, n-heptane, tetrahydrofuran, or mineral oil. Preferred solvent may be a commercial hexane containing principally hexane isomers. Reaction mixture may then be heated to reaction conditions of 60° C.–180° C., preferably 150° C.–170° C., say 155° C. at 15–300 psig, preferably 180–220 psig, say 200 psig.

Second functional monomer, typically phenothiazine is admitted in amount of 1–40 parts, say 4 parts, as a solution in 1–40 parts, say 16 parts of diluent-solvent-typically tetrahydrofuran (THF). This is followed by a solution in hydrocarbon of free radical initiator. Typical free radical initiators may include dicumyl peroxide, di-t-butyl peroxide, benzoyl peroxide, di-isopropyl peroxide, azobisisobutyronitrile, etc. The solvent is preferably the same as that in which the EPM or EPT is dissolved. The initiator may be added in amount of 0.2–40 parts, say 2 parts in 0.8–40 parts, say 6 parts of solvent hexane.

The reaction is carried out at a temperature at least as high as the decomposition temperature of the initiator, typically 60° C. or higher.

Reaction is typically carried out at 60° C.–180° C., say 155° C. and 180–220 psig, say 200 psig during which time bonding of second monomer onto the base EPM or EPT polymer occurs. The final product graft polymer may be characterized by the presence of units derived from first and second monomers.

Typically there may be 0.1–60, say 3 units derived from second monomer per 1000 carbon atoms in the charge polymer backbone.

For ease of handling, the polymerization solvent may be exchanged with a heavier solvent such as SUS 100 Oil. product graft polymer is typically obtained as a solution of 4–20 parts, say 8.5 parts thereof in 80–96 parts, say 91.5 parts of solvent.

Although it is preferred to graft the first monomer onto the base polymer and to thereafter bond the second monomer onto the so formed graft polymer, it is possible to effect simultaneous reaction of first and second monomers.

The product so formed may be an oil-soluble, substantially linear, carbon-carbon backbone polymer of molecular weight $\overline{M}_n$ of 10,000–1,000,000, preferably 20,000–200,000, say 140,000, bearing thereon (per 1,000 carbon atoms in the polymer backbone) 0.1–80 units, preferably 1–15 units, say 6 units of first graft monomer and 0.1–60 units, preferably 1–12 units, say 3 units of second monomer.

It is a feature of this invention that the so-prepared polymers may find use in middle distillate fuel oils as dispersant when present in effective amount of 0.001–2 w %, say 0.5 w %. Typical fuel oils may include middle distillate fuel oils including kerosene, home heating oils, diesel fuel, etc.

Lubricating oils in which the dispersant viscosity index improvers of this invention may find use may include automotive, aircraft, marine, railway, etc., oils; oils used in spark ignition or compression ignition; summer or winter oils; etc. Typically the lubricating oils may be characterized by an ibp of 570° F.–660° F., say 610° F.; an ep of 750° F.–1200° F., say 1020° F.; and an API gravity of 25–31, say 29.

A typical lubricating oil in which the polymer of this invention may be present may be a standard SAE 5W-30 hydrocarbon motor oil formulation having the following composition:

TABLE

| | W % |
|---|---|
| Base Oil | 82 |
| Viscosity Index Improver (10 w % ethylene-propylene copolymer in 90% inert oil) | 9 |
| Standard Additive Package: Polyisobutenyl ($\overline{M}_n$ 1290) succinimide (dispersant); calcium sulfonate (detergent); Zinc dithiophosphate (anti-wear); di-nonyl diphenyl amine (anti-oxidant); 4,4'-methylene-bis (2,6-di-t-butyl phenol) (antioxidant); | 9 |

Use of the additive of this invention makes it possible to readily increase the viscosity index by 25–40 units, say 35 units and to obtain improved ratings on the tests measuring the dispersancy of the system. The viscosity index is determined by ASTM Test D-445.

The novel polymers are also characterized as anti-oxidants as determined by the Bench Oxidation Test. In this test, a solution (8.5 wt. %) of test polymer in SNO-100 oil is diluted with SNO-130 oil to give a 1.5 wt. % solution of the test polymer. The solution is heated with stirring and air agitation. Samples are withdrawn periodically for analysis by Differential Infrared Absorption (DIR) to observe changes in the intensity of the carbonyl vibration band at 1710 $cm^{-1}$. Higher carbonyl vibration band intensity indicates a lower thermal-oxidative stability of the sample.

Dispersancy is determined by the Bench VC Test (BVCT). In this test, the turbidity of an oil containing an additive is measured after heating the test oil to which has been added a standard blow-by. The result correlates with dispersancy is compared to three reference standards (Excellent, Good, and Fair) tested simultaneously with the test sample. The numerical rating decreases with an increase in dispersant effectiveness. Results similar to or lower than that of the Good Reference indicate that the additive is a good dispersant.

It appears that the first graft monomer used in practice of this invention provides improved dispersant properties to the base polymer (which provides viscosity index improvement); and the second functional monomer provides improved anti-oxidant properties. Thus it is possible to obtain product polymers which serve as multi-functional additives (dispersant, anti-oxidant, viscosity index improvers) when added to a hydrocarbon lubricating oil or to a synthetic type lubricating oil.

It is a feature of this invention that the so-prepared graft polymers may find use in lubricating oils as dispersant anti-oxidant, viscosity index improvers when present in effective amount of 0.2–5 w %, preferably 0.4–3 w %, say 0.9 wt %.

The novel polymers may also be characterized as deposit protection agents as measured by the Single Cylinder CEC MWM-B Diesel Engine Test (DIN 51361 Parts I, II, and IV). In this test, a solution (8.5 wt. %) of polymer in SNO-100 oil is blended into a fully formulated oil which does not contain a VI improver. Results are presented in "Merits", a higher merit evidencing better protection against deposits.

It is a feature of this invention that the polymer products of this invention may be used in middle distillate fuel oils to permit attainment of improved storage stability as measured by the Potential Deposit Test (PDT)—ASTM Test D-2274.

A rating of 1 or 2 is good; and a rating of 3 or 4 is unsatisfactory.

It is possible by use of the compositions of this invention to improve the PDT rating of a charge diesel fuel from 4+ to a satisfactory rating of 1 by use of only 25 PTB (pounds per thousand barrels) of active ingredient. When used in fuels, the additives may be present in amount of 0.25–250, preferably 10–100, say 25 pounds per thousand barrels (PTB).

Practice of the process of this invention will be apparent to those skilled in the art from the following examples wherein, as elsewhere in this specification, all parts are parts by weight unless otherwise set forth. Control examples are designated by an asterisk.

DESCRIPTION OF PREFERRED EMBODIMENTS

EXAMPLE I

In this example which describes the best mode presently known, the charge EPM polymer is the polymer of molecular weight $\overline{M}_n$ of 140,000 of $\overline{M}_w/\overline{M}_n$ ratio of 1.6, and containing 60 mole % of units derived from ethylene and 40 mole % of units derived from propylene. 100 parts of this polymer are dissolved in 300 parts of commercial hexane and added to a reaction vessel.

In the first step, the mixture is heated to 155° C. with agitation under nitrogen atmosphere at 200 psig. N-vinyl pyrrolidone (5 parts dissolved in 15 parts of hexane) is added followed by 5 parts of 25 w % dicumyl peroxide in hexane. The reaction mixture is stirred for one hour.

In the second step, phenothiazine (4 parts) dissolved in 16 parts of tetrahydrofuran is added followed by a solution of 2 part of dicumyl peroxide initiator in 6 parts of commercial hexane. The mixture is stirred at 155° C. and 200 psig for 1 hour. Solvent Neutral Oil (SUS 100) (1076 parts) is then added; and the hexane is distilled off at 90°–120° C. The resulting solution contains about 8.5 w % polymer.

The product polymer contains (per 1000 carbon atoms of polymer backbone) about 6 units derived from N-vinyl pyrollidone and 3 units derived from phenothiazine.

The process of Example I may be carried out using the charge polymers of Examples II–IV:

EXAMPLE II

The Epsyn 4006 brand of EPT marketed by Copolymer containing 58 mole % of units derived from ethylene, 40 mole % of units derived from propylene, and 2 mole % of units derived from ethylidene norbornene and having a $\overline{M}_n$ of 120,000 and a $\overline{M}_w/\overline{M}_n$ of 2.2.

EXAMPLE III

The Ortholeum 2052 brand of EPT marketed by DuPont containing 62 mole % of units derived from ethylene, 36 mole % of units derived from propylene, and 2 mole % of units derived from 1,4-hexadiene and having a $\overline{M}_n$ of 35,000 and a $\overline{M}_w/\overline{M}_n$ of 2.

EXAMPLE IV

The Royalene brand of EPT marketed by Uniroyal containing 60 mole % of units derived from ethylene, 37 mole % of units derived from propylene and 3 mole % of units derived from dicyclopentadiene and having a $\overline{M}_n$ of 100,000 and a $\overline{M}_w/\overline{M}_n$ of 2.5.

EXAMPLE V*

In this control Example, the N-vinylpyrrolidone grafted EPM (as a 25 w % solution in hexane) is prepared as in Example I. Solvent hexane is exchanged for SNO-100 oil (1076 parts) to give a solution containing 8.5 w % polymer.

There are then added 4 parts of phenothiazine dissolved in 16 parts of tetrahydrofuran; and the mixture maintained at 70° C.–80° C. under nitrogen for one hour.

This mixture contains the same quantity of N-vinyl pyrrolidone and of phenothiazine as does the product of Example I. In this Example V*, the phenothiazine is merely admixed.

EXAMPLE VI*

In this control example, the procedure of Example V* is followed except that the phenothiazine in tetrahydrofuran is not added.

EXAMPLE VII

In this experimental Example, the procedure of Example I is followed except that the first graft monomer is (instead of N-vinylpyrrolidone) a monomer (8 parts) prepared by heating, for one hour at 100° C.–120° C., a mixture of equimolar amounts of allyl glycidyl ether and morpholine. The polymer product contains (per 1000 carbon atoms in the polymer backbone) 5 units derived from the reaction product of allyl glycidyl ether and morpholine and 3 units derived from phenothiazine. It is recovered as a 8.5 wt.% solution in SNO-100 oil.

EXAMPLE VIII*

In this control Example, the procedure of Example V* is followed except that the first graft monomer is the reaction product of allyl glycidyl ether and morpholine—prepared as in Example VII.

EXAMPLE IX*

In this control Example, the procedure of Example VI* is followed except that the first graft monomer is the reaction product of allyl glycidyl ether and morpholine—prepared as in Example VIII*.

EXAMPLE X

In this experimental example, the procedure of Example I is followed except that the first functional monomer is (instead of N-vinyl pyrrolidone) a monomer (6 parts) prepared by heating for one hour at 100° C.–120° C., a mixture of equimolar amounts of allyl glycidyl ether and N-methylpiperazine. The polymer product contains (per 1000 carbons of polymeric chain) 4 units derived from the reaction product of allyl glycidyl ether and N-methyl piperazine and 3 units derived from phenothiazine. It is recovered as a 8.5 wt. % polymer solution is SNO-100 oil.

EXAMPLE XI

In this experimental example, the procedure of Example I is followed except that the first functional monomer is (instead of N-vinyl pyrrolidone) a monomer (8 parts) prepared by heating for one hour at 90°–100° C., a mixture of equimolar amounts of croton aldehyde and N-(3-aminopropyl)morpholine. The polymer product contains (per 1000 carbons of polymeric chain) 4.5 units derived from the reaction product of croton aldehyde and N-(3-aminopropyl) morpholine, and 3 units derived from phenothiazine. It is recovered as a 8.5 wt. % solution in SNO-100 oil.

EXAMPLE XII

In this experimental example, the charge EPM polymer has a molecular weight $\overline{M}_n$ of 140,000, $\overline{M}_w/\overline{M}_n$ ratio of 1.6, and contains 60 mole % of units derived from ethylene and 40 mole % of units derived from propylene. 100 parts of this polymer are dissolved in 300 parts of commercial hexane and added to a reaction vessel.

The mixture is heated to 155° C. with agitation under nitrogen at 200 psig. There are added (i) 5 parts of N-vinylpyrrolidone, dissolved in 15 parts of hexane, (ii) 2 parts of phenothiazine, dissolved in 8 parts of tetrahydrofuran, and (iii) 6.0 parts of dicumyl peroxide dissolved in 18 parts of hexane.

The mixture is stirred at 155° C. and 200 psig for one hour under nitrogen. Solvent Neutral Oil (SUS 100) is then added (1076 parts); and the hexane is distilled off at 90° C.–120° C. The resulting solution contains about 8.5 w % polymer.

The product polymer contains (per 1000 carbon atoms in the polymer backbone) about 6 units derived from N-vinyl pyrrolidone and 1.5 units derived from phenothiazine.

Each of the products of Examples I and V*–XII is formulated with a fully formulated base blend to yield a composition containing 0.85 wt. % polymer; and these compositions are subjected to the Bench VC Test (BVCT).

The fully formulated base blend contains the following components:

TABLE

| Components | W % |
|---|---|
| SNO-130 Oil | 75.25 |
| SNO-320 Oil | 21.64 |
| Zinc dithiophosphate (anti-wear) | 1.12 |
| Naugalube 438 Brand of 4,4'-di-nonyl-di-phenyl amine (anti-oxidant) | 0.39 |
| Surchem 521 Brand of Mg Sulfonate (detergent) | 1.50 |
| Silicone polymer (anti-foamant) | 150 ppm |

TABLE

| Property | Value |
|---|---|
| Viscosity Kin | |
| 40° C. CS | 31.50 |
| 100° C. CS | 5.36 |
| Pour Point °F. | +5 |
| Ash sulfated % (ASTM D-874) | 0.93 |
| Phosphorus % (X-ray) | 0.11 |
| Sulfur % (X-ray) total | 0.40 |
| Zinc % (X-ray) | 0.12 |

The products of Examples I and V*–XII are subjected to the Bench Oxidation Test to determine whether the additive is a satisfactory anti-oxidant. In this test, products of Examples I and V*–XII are formulated with SNO-130 Oil to yield a solution containing 1.5 wt. % polymer. The solution is heated with stirring and air agitation. Samples are withdrawn periodically and analyzed by Differential Infrared Absorption (DIR) to observe changes in the intensity of the carbonyl vibration based at 1710 $cm^{-1}$. They are also tested in the Clarity Test and the Lumetron Turbidity Test.

The Oxidation Index is reported as the Carbonyl Group Absorbence in the Differential Infrared Spectra after 144 hours of oxidation. The Oxidation Index may range from 0 up to 100 and a low rating is desired. A rating below 4 is considered excellent.

The Clarity of the samples is also reported visually and by the Lumetron Turbidity Test after 144 hours. In the Lumetron Turbidity Test, product turbidity is determined by a Lumetron Photoelectric Colorimeter.

The Lumetron Turbidity is reported on a scale of 0–100. A rating of below about 20 is satisfactory; higher ratings are less satisfactory.

TABLE

| | | Clarity at 144 hours | | | Standards |
|---|---|---|---|---|---|
| Example | Oxidation Index | Visual | Lumetron Turbidity | BVCT | Excellent/ Good/Fair |
| I | 1.8 | Clear | 16 | 32.1 | 9.1/31.0/61.0 |
| V* | 2.5 | Turbid | 100 | — | |
| VI* | 9.5 | Turbid | 100 | 36.0 | 10.1/27.7/51.9 |
| VII | 2.5 | Clear | 20 | 34.8 | 9.1/31.0/61.0 |

TABLE-continued

| Example | Oxidation Index | Clarity at 144 hours Visual | Lumetron Turbidity | BVCT | Standards Excellent/ Good/Fair |
|---|---|---|---|---|---|
| VIII* | 3.0 | Turbid | 100 | — | |
| IX* | 13.0 | Turbid | 100 | 38.5 | 15.8/31.8/64.6 |
| X | 1.8 | Clear | 16 | 23.1 | 11.1/25.2/65.3 |
| XI | 1.7 | Clear | 14 | 37.1 | 13.7/25.8/68.2 |
| XII | 2.2 | Clear | 18 | 36.0 | 10.2/28.3/52.1 |

From the above Table, it is apparent that the experimental Examples I, VII, and X–XII are characterized by a desirably low Oxidation Index (i.e. freedom from oxidation), by a visually clear reading, and by a desirably low Lumetron Turbidity rating. Control Examples VI*, and IX* which fall outside the scope of this invention are characterized by undesirably higher oxidation indices, by a visually turbid reading, and by undesirably high Lumetron Turbidity rating. Control Examples V* and VIII* are unsatisfactory by the latter two criteria.

Experimental Examples I, VII, and X–XII are also characterized by satisfactory BVCT ratings.

It is clear from these tests that the products of the instant invention which contain polymers bearing first dispersant graft monomers and second anti-oxidant monomers possess the ability to form lubricating oils characterized by desirable properties including high dispersancy, anti-oxidant activity, and desirable viscosity index.

EXAMPLE XIII*

In this control Example, a base diesel fuel having the following properties is tested in the Potential Deposit Test and found to have an unsatisfactory rating of 4+.

TABLE

| Property | Value |
|---|---|
| Lumetron Turbidity | 8 |
| Sp. Gr. 60/60F | 0.8606 |
| Color ASTM | 3.0 |
| Kin. Vis. (cSt @ 100° C.) | 805.5 |
| Flash Point (COC) | 415 |
| Ash % | 0.02 |

EXAMPLE XIV

In this experimental Example, there is added to the base fuel of Example XIII*, 8.5 w % of the polymer of Example I to yield a mix containing 25 PTB (corresponding to 0.01 wt. % or alternatively to a nitrogen content of 0.054 w %).

The modified diesel fuel is found to have a PDT rating of 1 which is satisfactory.

EXAMPLE XV

In this control Example, a commercial olefin copolymer dispersant VI improver is blended into formulated oil not containing a VI improver. The blend is subjected to the single cylinder MWM-B Diesel Engine Test. In this test, results are presented in merits which correlate with amount of deposits. Higher merits correspond to lower deposits.

EXAMPLES XVI–XVII

In these experimental Examples, the procedure of Example XV* is followed except that the product of Example I is added in Example XVI and the product of Example X is added in Example XVII (instead of the commercial olefin copolymer dispersant VI improver) to a formulated oil not containing a VI improver.

TABLE

| Example | Polymer Product Example | MWM-B Merits |
|---|---|---|
| XV* | Commercial DOCP VII | 53 |
| XVI | I | 64 |
| XVII | X | 63 |

From the above table, it is apparent that the experimental Examples XVI and XVII are characterized by a better deposit protection (higher merits) than the commercial dispersant olefin copolymer VI improver of Example XV*.

Although this invention has been illustrated by reference to specific embodiments, it will be apparent to those skilled in the art that various changes and modifications may be made which clearly fall within the scope of this invention.

What is claimed is:

1. A graft polymer characterized by its ability to serve as a dispersant, anti-oxidant viscosity index improver comprising an oil-soluble, substantially linear, carbon-carbon backbone polymer bearing (i) first graft units derived from a first monomer amine containing a polymerizable, ethylenically unsaturated double bond and (ii) bonded to said graft polymer, second units derived from phenothiazine as second monomer.

2. A graft polymer characterized by its ability to serve as a dispersant, anti-oxidant viscosity index improver comprising an oil-soluble, substantially linear, carbon-carbon backbone polymer bearing (i) first graft units derived from a first monomer amine containing a polymerizable, ethylenically unsaturated double bond and (ii) bonded to said graft polymer, second units derived from the reaction product of allyl glycidyl ether and phenothiazine as second monomer.

3. A graft polymer characterized by its ability to serve as a dispersant, anti-oxidant, viscosity index improver comprising an oil-soluble, substantially linear carbon-carbon backbone polymer of molecular weight $\overline{M}_n$ of 10,000–1,000,000, derived from ethylene-propylene copolymer or ethylene-propylene-diene third monomer backbone terpolymer, said backbone polymer bearing first graft units derived from N-vinylpyrrolidone and, bonded to said graft polymer, phenothiazine.

* * * * *